US007467952B2

(12) United States Patent
Hsiao et al.

(10) Patent No.: US 7,467,952 B2
(45) Date of Patent: Dec. 23, 2008

(54) ELECTRICAL CONTACT FOR EASE OF ASSEMBLY

(75) Inventors: Shih-Wei Hsiao, Tu-cheng (TW); Chun-Fu Lin, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/074,340

(22) Filed: Mar. 3, 2008

(65) Prior Publication Data

US 2008/0214063 A1 Sep. 4, 2008

(51) Int. Cl.
*H01R 12/00* (2006.01)

(52) U.S. Cl. ..... 439/66; 439/700

(58) Field of Classification Search ..... 439/66, 439/700, 824, 482

See application file for complete search history.

(56) References Cited

U.S. PATENT DOCUMENTS 6,159,056 A * 12/2000 Boyle ..... 439/700
6,814,626 B2 * 11/2004 Wen-Yao ..... 439/700
7,025,602 B1 4/2006 Hwang
7,285,026 B1 * 10/2007 Ju ..... 439/700
7,300,288 B1 * 11/2007 Chen et al. ..... 439/66

FOREIGN PATENT DOCUMENTS

| | | |
|---|---|---|
| CN | 200950476 Y | 9/2007 |
| CN | 200956487 Y | 10/2007 |
| TW | M316515 | 8/2007 |
| TW | M321163 | 10/2007 |
| TW | M322638 | 11/2007 |

* cited by examiner

*Primary Examiner*—Hien Vu
(74) *Attorney, Agent, or Firm*—Wei Te Chung

(57) ABSTRACT

A contact includes a first contact pin, a second contact pin and a spring. The first contact pin comprises a wide portion for contacting and a narrow portion. The second contact pin comprises a holding portion and a guiding portion extending upwards from the holding portion. The guiding portion has a receiving space and a pair of channels, the narrow portion is received in the receiving space and has thereof a pair of projecting portions sliding in the channels. The spring is moveably seated on the holding portion and limited under the wide portion to allow the first contact pin to shift upwards and downwards therein.

7 Claims, 8 Drawing Sheets

ELECTRICAL CONTACT FOR EASE OF ASSEMBLY

BACKGROUND OF THE INVENTION

1. Field of the Invention

The present invention relates to an electrical contact for electronic devices, and more particularly to a contact for electronic devices which electrically connects an integrated circuit (IC) provided in a test socket to a printed circuit board (PCB). The contact features a first part and a second part moveably assembled to the first part, and a biasing device arranged therebetween to push the first and second part apart from each other.

2. Description of the Related Art

U.S. Pat. No. 7,025,602 issued to Hwang; Dong Weon on Apr. 11, 2006 discloses a conventional contact which comprises a pope body, an upper and lower contact pins and a spring arranged therebetween. The upper and lower contact pins and the spring are all arranged uprightly in a line and received in the pipe body. The spring is defined between the first upper and lower contact pin and provides a flexible force for the two contact pins moving upwards and downwards. The top ends of the upper contact pin and the bottom end of the lower contact pin project out the opening at the opposite ends of the pipe body respectively. The openings are narrow for preventing the two contact pins from falling off the pipe body while moving.

The electrical contact said above has following disadvantages. First, the upper and lower contact pins are of cylindrical shape, and not easy in manufacture. Second, the lower contact pin, the spring and the upper contact pin should be assembled on the pipe body orderly, resulting in a complex assembly. Third, the openings are easy to be abrade by the high-frequency friction between two contact pins and the pipe body.

Hence, it is desirable to provide an improved electrical contact to overcome the aforementioned disadvantages.

SUMMARY OF THE INVENTION

An object of the present invention is to provide an electrical contact for electronic device, which is easily produced and assembled.

In order to achieve the above-mentioned object, an electrical contact in accordance with the present invention comprises a first contact pin, a second contact pin and a spring; the first contact pin comprises a wide portion for contacting and a narrow portion extending downwards from the wide portion, the narrow portion defines a pair of projecting portions thereof; the second contact pin has a holding portion and a guiding portion extending upwards from the holding portion, the guiding portion has a receiving space and a pair of channels, the narrow portion is received in the receiving space and the projecting portions slid in the channels; the spring is moveably seated on the holding portion and is limited under the wide portion to allow the first contact pin to shift downwards and upwards therein.

Other features and advantages of the present invention will become more apparent to those skilled in the art upon examination of the following drawings and detailed description of preferred embodiments.

DETAILED DESCRIPTION OF PREFERRED EMBODIMENT

Figure 1:
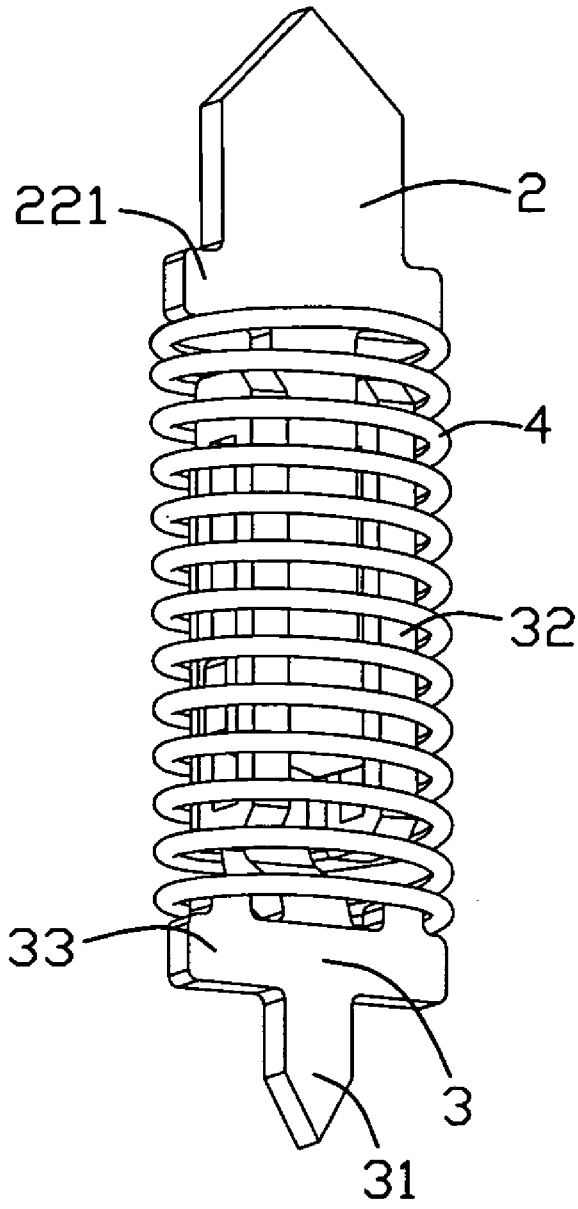
FIG. 1 is an assembled perspective view of a contact in accordance with the present invention.

Reference will now be made to the drawing figures to describe the preferred embodiments of the present invention in detail.

A contact in accordance with the present invention is adapted for being arranged in a test socket or a burn-in socket for receiving an IC and electrically connecting the IC to a PCB next. In such a state, the test socket performs a test of the IC.

Figure 2:
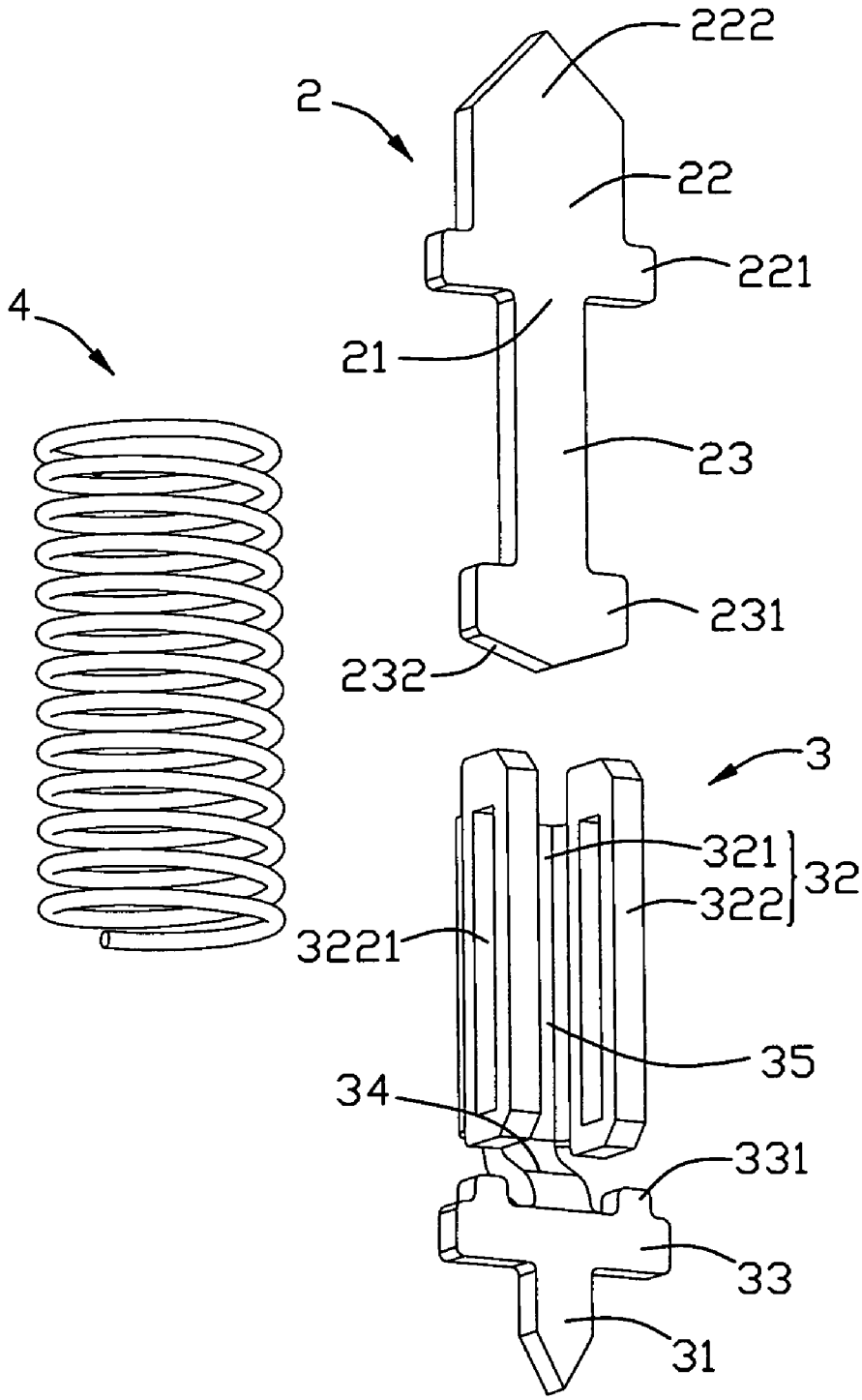
FIG. 2 is an exploded perspective view of the contact of FIG. 1.

Referring to FIGS. 1 and 2 showing the first embodiment of the invention, the contact includes a first or upper contact pin 2, a second or lower contact pin 3 and a coin spring 4. The first contact pin 2 is produced by fabricating an elongated sheet metal and includes an elongated base portion 21. The base portion 21 comprises a wide portion 22 and a narrow portion 23 extending downwards from the wide portion 22. The wide portion 22 has a sharp top end 222 for contacting with the IC, and a first projecting portion 221 defined at each lateral side of a bottom end of the wide portion 22. The spring 4 is positioned under the first projecting portions 221, and it can't cross over the first projecting portions 221 since the transverse length of two first projecting portions 221 is wider than the diameter of the spring 4. A second projecting portion 231 is defined at each lateral side of a bottom end of the narrow portion 23, a pair of declined planes 232 is defined on the bottom of the second projecting portions 231.

The second contact pin 3 is produced by fabricating a sheet metal and includes a holding portion 33, a solder portion 31 extending downwards from the center of the holding portion 33, a lengthwise guiding portion 32 extending upwards, and a bending portion 34 connecting the guiding portion 32 and holding portion 33 together.

The holding portion 33 defines a pair of upward tubers 331 adjacent two opposite ends thereon. Another end of the spring 4 is seated on the holding portion 33 and positioned outside the tubers 331. The transverse length of the holding portion 33 is wider than the diameter of the spring 4 to restrict the downward movement of the spring 4, thereby the spring 4 is not easy to detach from the second contact pin 3.

The guiding portion 32 includes a central plate 321 linking with the free end of the bending portion 34 and a pair of face-to-face guiding plates 322 which is bent from two opposite sides of the central plate 321 separately. A bending portion 34 extends slantways and upwards from the center of the holding portion 33 to make the holding portion 33 being coplanar with a central plane of the guiding portion 32, and ensures the contact to be in a line after assembled. The guiding plates 322 and the central plate 321 together form a receiving space 35 for receiving the narrow portion 23 of the first contact pin 2. Each guiding plate 322 has a stamped channel 3221 extending along an extending direction of the guiding portion 32, which is in a longitudinal rectangular shape as the guiding plate 322. The first contact pin 2 could be inserted into the receiving space 35 from the top of the guiding plates 322 by the guidance of the inclined planes 232. The second projecting portions 231 are received and shifting in the channels 3221 respectively. The channel 3221 has a top inner face or a stopping face (not labeled) for blocking the second projecting portion 231. So the first and second contact pins 2, 3 are not easily detached after assembled.

The three members 2,3,4 of the contact are not easy to detached from each other after assembly in accordance with above statement, so all the contacts of the socket could be assembled first, and then put them in an insulative housing of the socket. The assembly process of the contact is easier than the conventional contact thereby.

Figure 3:
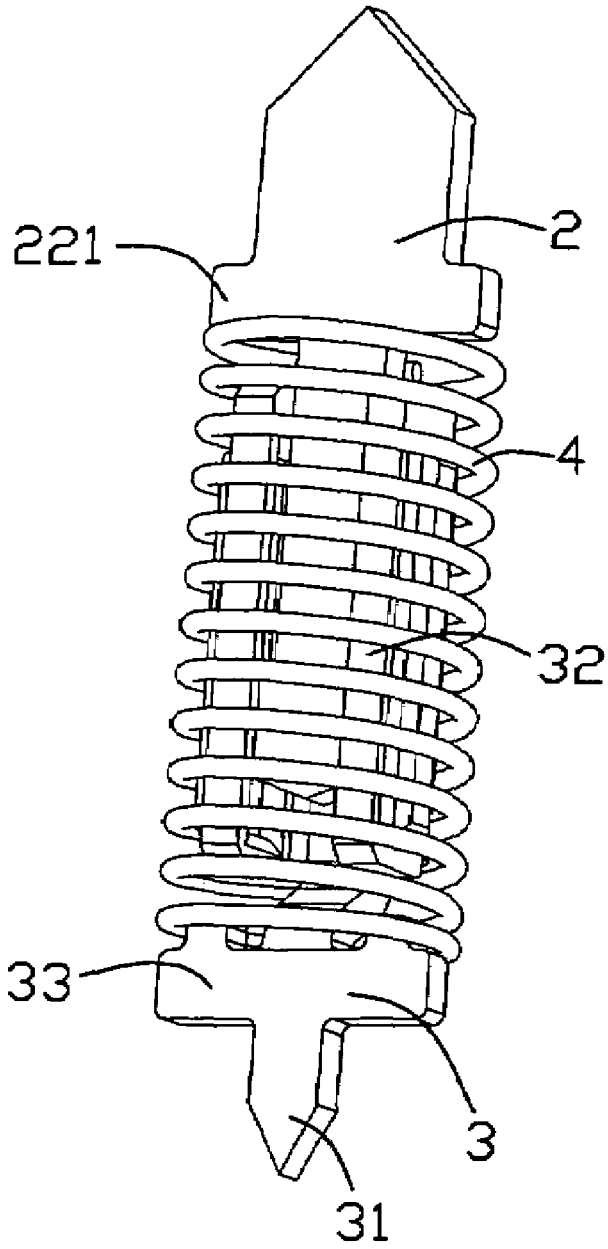
FIG. 3 is an assembled perspective view of a contact in accordance with a second embodiment of the present invention.
Figure 4:
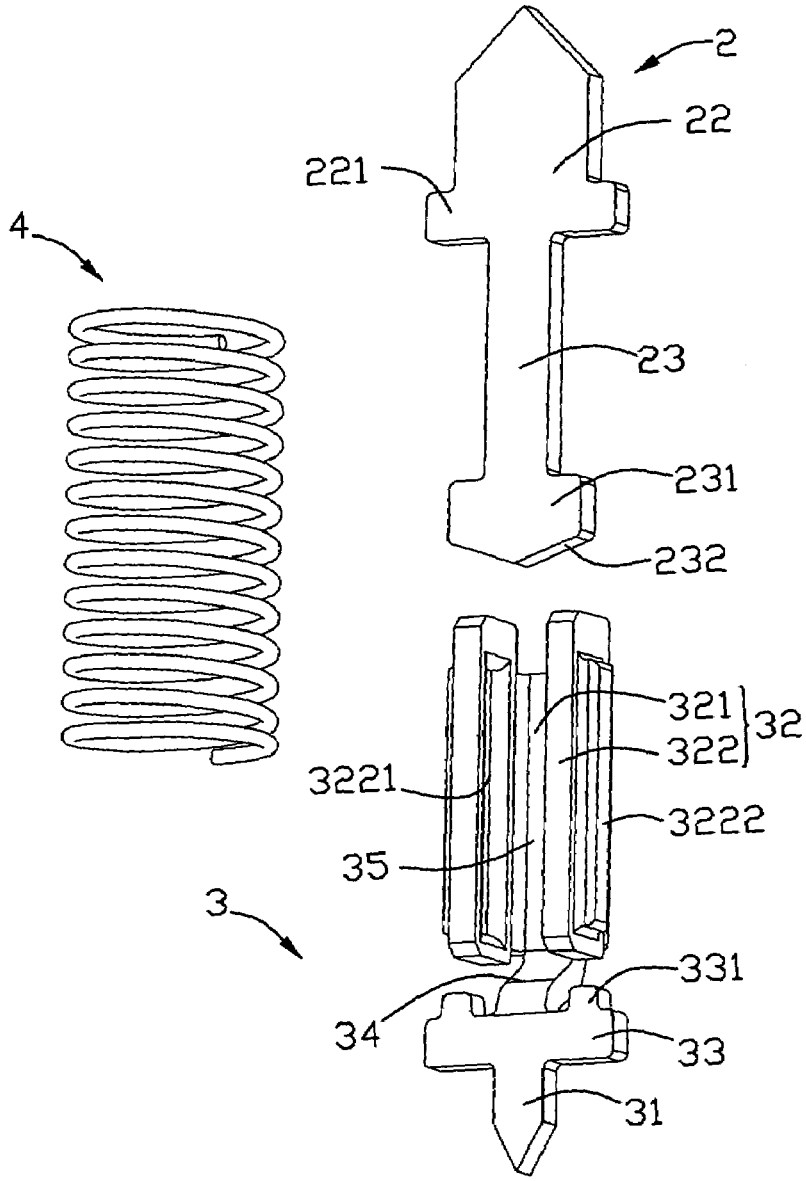
FIG. 4 is an exploded perspective view of the contact of FIG. 3.

Referring to FIGS. 3 and 4, a contact in accordance with a second embodiment of the present invention is disclosed. The embodiment is similar to the first embodiment said above in structure and function, but has some difference on the guiding plates 322. Each guiding plate 322 is drawn outwards to define a channel 3221 without being opened outwards, namely a close portion 3222. The second projecting portions 231 could be protected by the close portion 3222.

Figure 5:
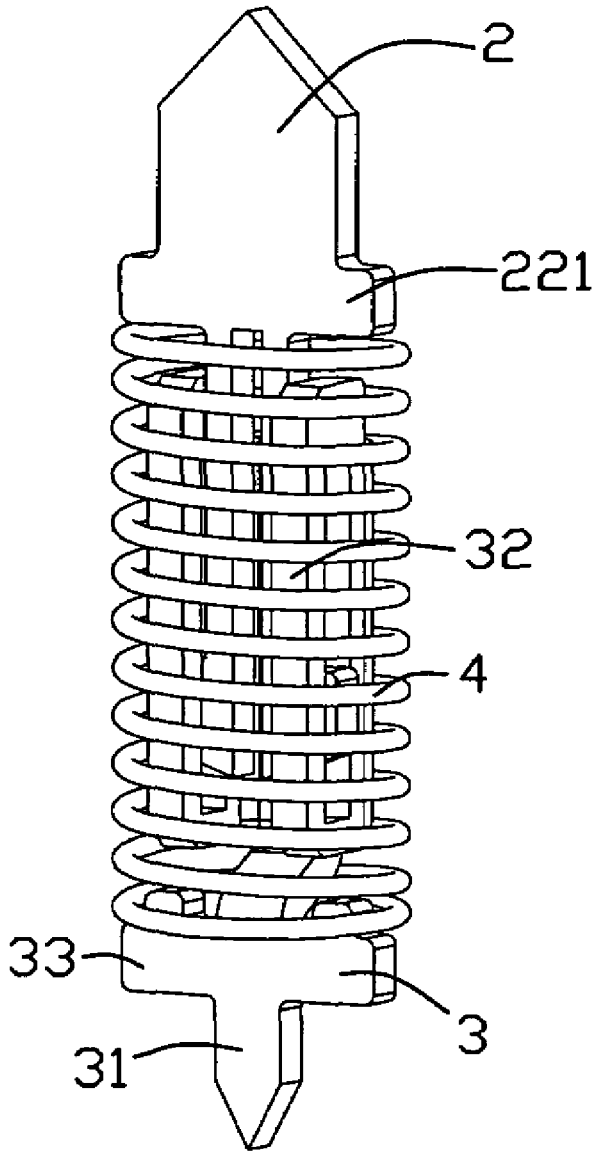
FIG. 5 is an assembled perspective view of a contact in accordance with a third embodiment of the present invention.
Figure 6:
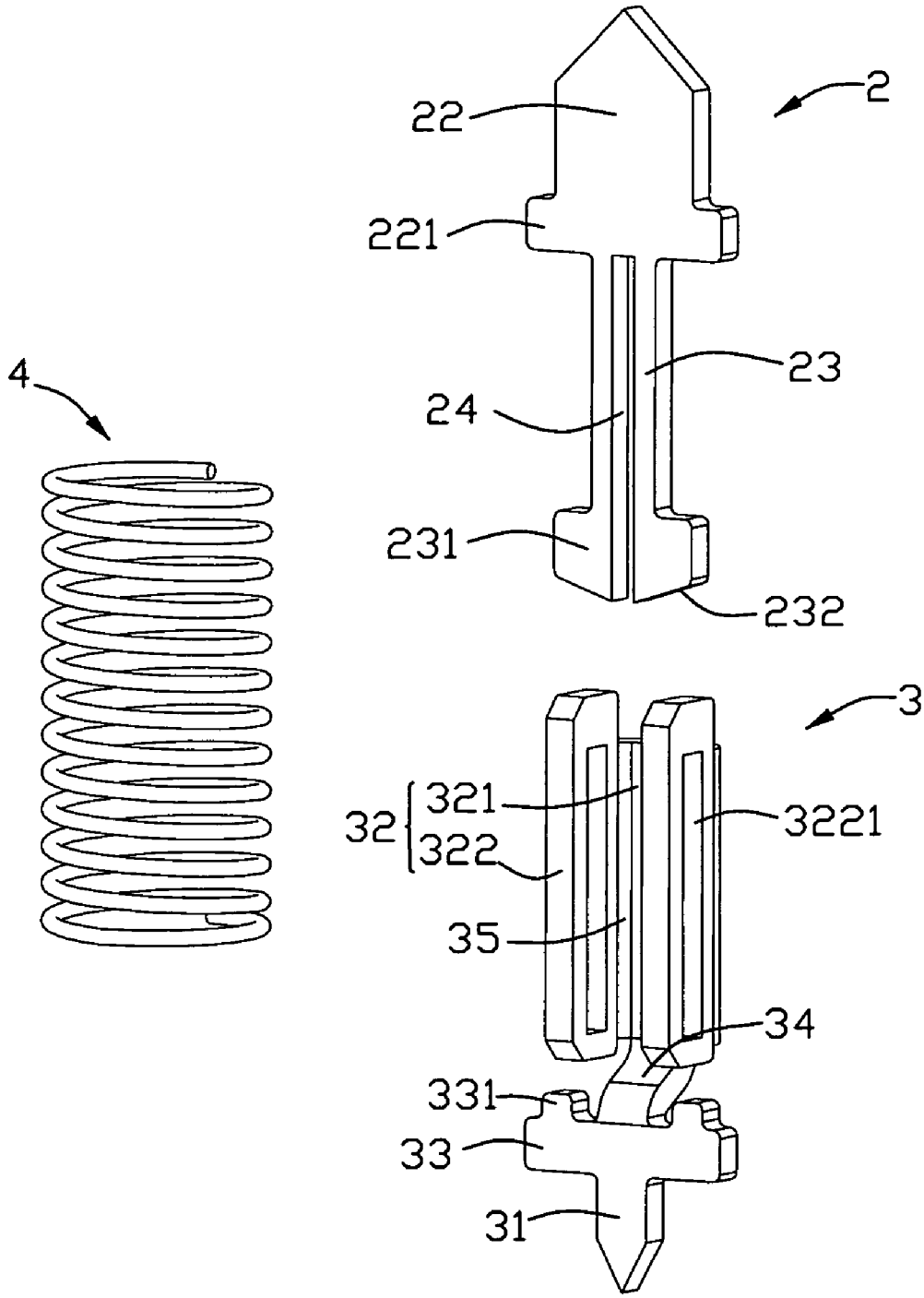
FIG. 6 is an exploded perspective view of the contact of FIG. 5.

Referring to FIGS. 5 and 6, a contact in accordance with a third embodiment of the present invention is disclosed. The embodiment is similar to the first embodiment said above in structure and function, but has some difference on the narrow portion 23. The narrow portion defines a central slot 24 recessing upwards from the bottom of the second projecting portion 231 to the bottom end of the first projecting portion 221, and divides the narrow portion 23 into two flexible portions thereby. The slot 24 is used for increasing the resilience of the narrow portion 23 and guiding the narrow portion 23 to be inserted into the channels 3221 more conveniently.

Figure 7:
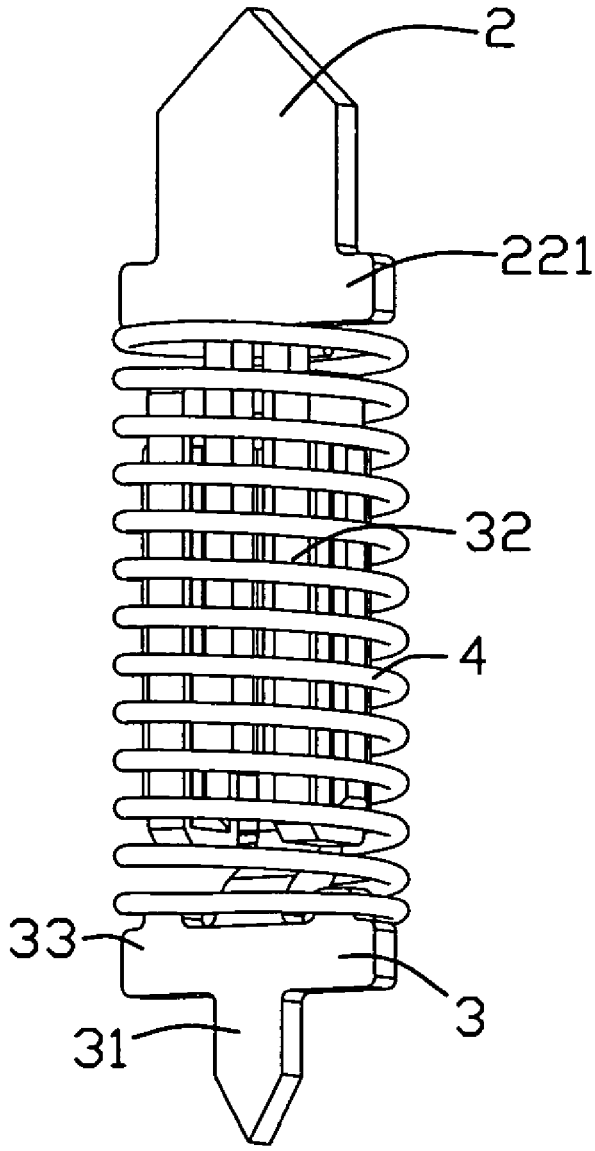
FIG. 7 is an assembled perspective view of a contact in accordance with a forth embodiment of the present invention.
Figure 8:
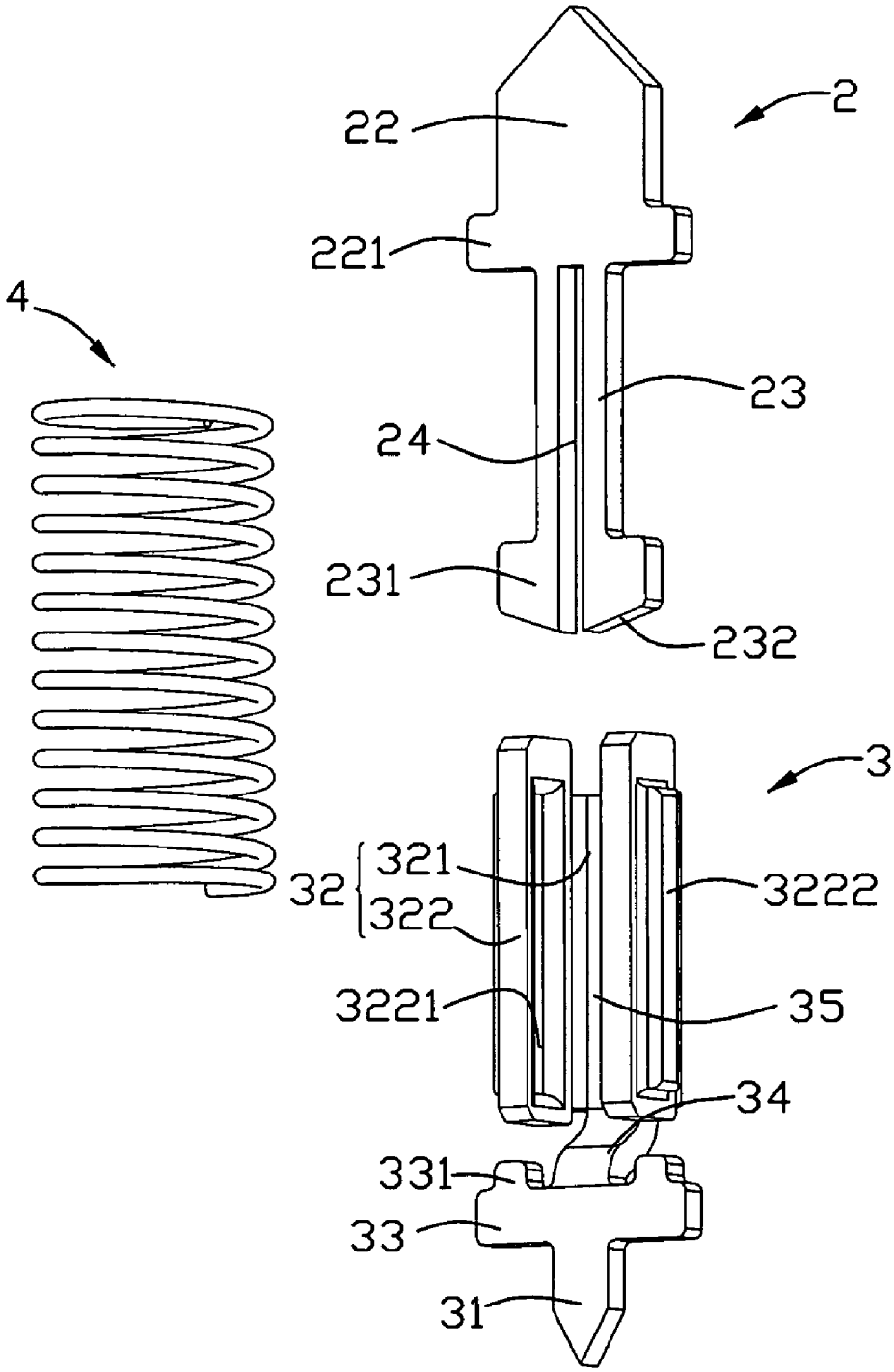
FIG. 8 is an exploded perspective view of the contact of FIG. 7.

Referring to FIGS. 7 and 8, a contact in accordance with a forth embodiment of the present invention is disclosed. The contact comprises a first contact pin 2 same to the first contact pin 2 of the second embodiment, a second contact pin 3 same to the second contact pin 3 of the third embodiment, and a spring 4 as shown.

While the present invention has been described with reference to preferred embodiments, the description of the invention is illustrative and is not to be construed as limiting the invention. Various of modifications to the present invention can be made to preferred embodiments by those skilled in the art without departing from the-true spirit and scope of the invention as defined by the appended claims.

What is claimed is:

1. A contact comprising:

a first contact pin comprising a wide portion for contacting and a narrow portion extending downwards from the wide portion;

a second contact pin comprising a holding portion and a guiding portion extending upwards from the holding portion, the guiding portion having a receiving space and a pair of channels, the narrow portion being received in the receiving space and having thereof a pair of projecting portions sliding in the channels; and a spring movably seated on the holding portion and engaged under the wide portion of the first contact pin to allow the first contact pin to move downwards and upwards therein;

wherein the narrow portion comprises a pair of resilient arm portions with the projecting portions at free ends thereof;

wherein the guiding portion comprises a central plate and a pair of face-to-face guiding plates being bent from two opposite sides of the central plate, the receiving space is provided by the central plate and the guiding plates;

wherein the second contact pin includes a bending portion which extends slantways and upwards from the holding portion to ensure the contact to be in a line after assembly, and the central plate extends upwards from the bending portion; and wherein the holding portion defines a pair of upward tubers adjacent two opposite ends for retaining the spring on the holding portion.

2. The contact of claim 1, wherein the projecting portions of the narrow portion define a pair of decline planes on the bottom for guiding the narrow portion to be inserted into the channels.

3. The contact of claim 1, wherein the first contact pin defines a pair of projecting portions at the bottom of the wide portion, the spring is under the projecting portions since its diameter is narrower than corresponding transverse length of the projecting portions.

4. The contact of claim 1, wherein the guiding plate defines a closing portion which is drawn outwards from the guiding plate for occluding the channel.

5. The contact of claim 1, wherein the second contact pin has a solder portion extending downwards from the holding portion.

6. A contact comprising:

a first piece essentially being in a planar manner and including a stem section with a pair of lateral projections on two sides and a first longitudinal end section thereof;

a second piece including a second longitudinal end section having a holding portion and a pair of opposite guiding plates defining therein guiding slots extending in a vertical direction and transversely through the corresponding guiding plates to respectively receive said pair of lateral projections; and a coil spring surrounding both said first piece and said second piece;

wherein the first piece and the second piece have engagement sections respectively engaged with different ends of the spring to constant urge the first piece and the second piece away from each other;

wherein said pair of guiding plates are linked by a central plate which is essentially parallel to said second end section;

wherein the holding portion defines a pair of upward tubers adjacent two opposite ends for retaining the spring on the holding portion.

7. The contact as claimed in claim 6, wherein said first longitudinal end section and said second longitudinal end section are essentially coplanar with each other.

* * * * *